United States Patent [19]

Martin et al.

[11] 4,127,365

[45] Nov. 28, 1978

[54] GEAR PUMP WITH SUCTION SHOE AT GEAR MESH POINT

[75] Inventors: Thomas B. Martin, Pleasant Hill; Ferdinanders Pieters, Concord, both of Calif.

[73] Assignee: Micropump Corporation, Concord, Calif.

[21] Appl. No.: 763,523

[22] Filed: Jan. 28, 1977

[51] Int. Cl.[2] ..... F04B 17/00; F01C 1/18; F01C 19/10; F04C 1/08

[52] U.S. Cl. ..... 417/420; 418/126; 418/129; 418/131; 418/135; 417/410

[58] Field of Search ..... 418/126, 129, 131, 135, 418/132; 417/410, 420

[56] References Cited

U.S. PATENT DOCUMENTS

| | | | |
|---|---|---|---|
| 2,211,154 | 8/1940 | Oshei | 418/126 |
| 2,817,297 | 12/1957 | Mosbacher | 418/126 |
| 2,936,717 | 5/1960 | Kalle | 418/131 |
| 3,465,681 | 9/1969 | Zimmermann | 417/420 |
| 3,495,538 | 2/1970 | Kruckeberg | 417/410 |
| 3,890,068 | 6/1975 | Davidson | 418/135 |

FOREIGN PATENT DOCUMENTS

| | | | |
|---|---|---|---|
| 561,793 | 4/1957 | Italy | 418/135 |

*Primary Examiner*—John J. Vrablik
*Attorney, Agent, or Firm*—Julian Caplan

[57] ABSTRACT

A pump has a block and a cup-like member having a rim engaging the block to define a pump cavity. Recessed into the block and opening or extending into the cavity are an inlet and an outlet duct and three parallel pins. The drive and driven gears are mounted on two of the pins, one face of each gear being tight against the block, and the two ducts are on opposite sides of the mesh point of the gears. A shoe is mounted on the third pin and overlies the inlet duct and the mesh point of the gears plus about two teeth to either side of the mesh point. A spring biases the shoe into contact with portions of the gears and the block to define a pump chamber. After a differential between the inlet and outlet duct pressures is established, this differential supplements the spring. One means of driving the drive gear comprises a motor driven annular magnet on the outside of the cup-like member and a smaller magnet within the cup-like member drivingly connected to the drive gear.

9 Claims, 8 Drawing Figures

GEAR PUMP WITH SUCTION SHOE AT GEAR MESH POINT

This invention relates to a new and improved gear pump with a suction shoe at the gear mesh point which shoe also forms a passage way from the inlet duct to said mesh point.

A particular feature of the invention is the provision of a pump cavity containing gears with an inlet duct on one side of said mesh point and an outlet duct on the opposite side. A shoe fits over the mesh point of the gears and at least a span of two teeth to either side thereof and also fits around the inlet duct and thus isolates this area from the pump cavity to establish a pump chamber within the pump cavity.

Another feature of the invention is the fact that the suction shoe is a part which is separate from the other elements of the structure and is supported by the pump body but is held in place primarily by pressure differential except at the commencement of operation when a spring holds the shoe in position until the pressure differential is established.

Another feature of the invention is the provision of a shoe which separates the inlet from the discharge pressure while accepting fluid flow.

The structure hereinafter described greatly improves the volumetric efficiency of the pump, specifically in that there is less loss of flow with rise in pressure than in conventional gear pumps. Hence it is no longer necessary to design a pump twice as large as the application requires in order to acheive performance at elevated pressure. The result of this volumetric efficiency is that the power requirements are reduced, a smaller pump may be used than in previous installation, metering is now feasible, a suction down to vapor pressure is available, a substantially dry lift is now available and, by proper choice of materials, air or gas may be pumped.

Another feature of the invention is the fact that the pump may be constructed in accordance with the description hereinafter set forth to accommodate wide temperature variation of the range of −100° to 260° F. with no effect on the performance or durability of the pump, viscosity changes of fluid due to temperature not included. Hence pumps constructed as hereinafter described may be sterilized by autoclaving with no adverse effect. With special protection for the motor, wide temperature ranges are possible.

Another feature of the invention is the fact that both the pump gears and a magnet, if a magnet drive is employed, are located in the same cavity. Flushing to change fluids or to sterilize the pump is relatively simple and no special provisions therefor are required.

Pump life for some applications with clean fluids can be considered infinite and there is no degradation of performance with time. Such wear as does occur does not degrade the pump performance. By using carbon gears and no bushings, wear is substantially eliminated.

By the construction set forth herein, pressures of up to 200 psi using water may be handle by employing a tighter fit and better bearing materials. By using more and smaller teeth on the gears, and therefore a bigger pin supporting the gears, larger bearings may be used to support the load. A smaller suction shoe may be used, thereby reducing the load on the bearings.

The external configuration of the pump is similar to prior pumps but quite different in design. The pump body is, in fact, merely a manifold which contains only the inlet and outlet ports and ducts, an externally adjustable by-pass (not shown herein) and other control functions which may be required. The inlet and outlet ports may be located side-by-side or at various angles to each other and either on the top or side or front of the manifold. The use of a suction shoe in accordance with this invention allows for a wide range of design sophistication. Close tolerances result in high volumetric efficiency but where such efficiency is not required, looser fits and wider tolerences may be employed. Therefore the design of the pump lends itself to a wide range of cost effectiveness and pricing.

Since carbon gears will run even when dry, the pump may be used for air or gas with some limitations. In fact, the same basic structure will accommodate an assortment of pump designs to meet the application and these designs can be computed rapidly by computer and the parts may be dimensioned in accordance with the computer readouts.

A further result of the high volumetric efficiency which results from the present invention enables the pump to be used as a metering pump. Variable speed DC and AC/DC motors may be precisely controlled as to speed. By counting the number of revolutions a measured amount of fluid may be pumped.

Other objects of the present invention will become apparent upon reading the following specification and referring to the accompanying drawings in which similar characters of reference represent corresponding parts in each of the several views.

Figure 1:
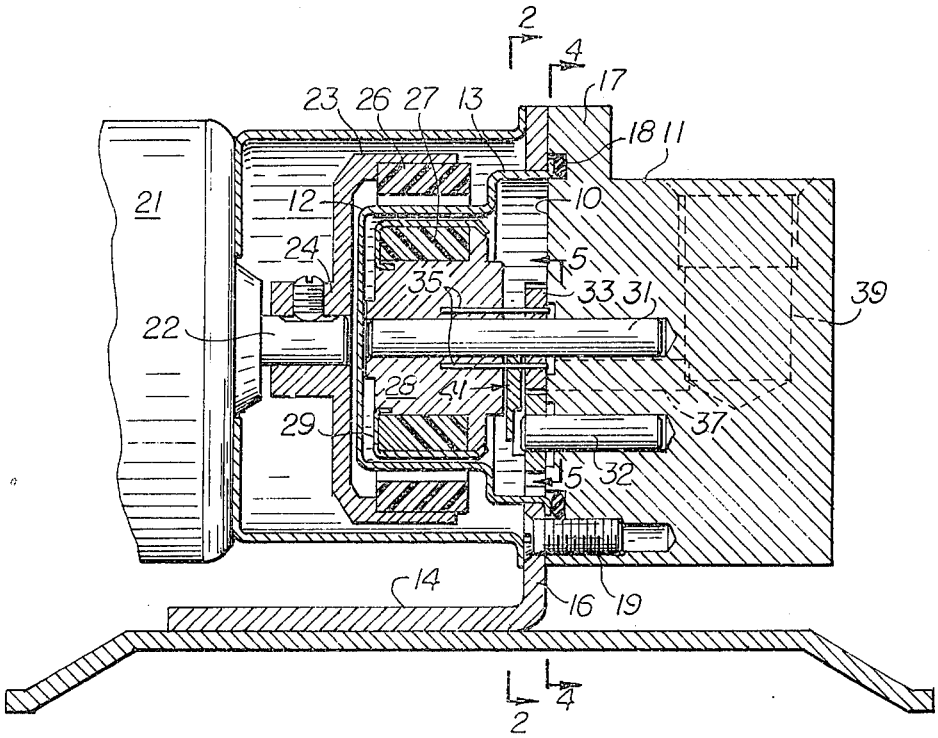
FIG. 1 is a vertical mid-section through the pump.

In the form of the invention hereinafter set forth in detail, a pump block 11 is provided having an inner face 10 which engages the rim of a cup-like member 12, thereby providing a pump cavity 13 between the cup 12 and block 11. For such purpose a flange 17 is formed on block 11, a seal 18 is recessed into the face 10 of block 11 to provide a fluid tight seal against the rim of cup 12 to define the cavity 13. A bracket 14 supports the pump and a ring-like flange 16 of bracket 14 is secured to the flange 17 by screws 19.

The drive for the pump consist of a motor 21 having a shaft 22. In the form of the invention shown in FIG. 1, the pump is driven from shaft 22 by a magnet drive and cup 12 is non-magnetic. Thus a magnet-holding flange 23 has a hub 24 which is driven by shaft 22 and carried within the flange 23 is the drive magnet 26 which is preferably annular. The driven magnet 27, located within cavity 13, is also annular and concentric with the magnet 26. Driven magnet 27 is supported by magnet holder 28 and held in place by retainer 29. The holder 28 turns on main pin 31 which is supported at its end opposite holder 28 by the pump block 11 into which it is recessed. Parallel to pin 31 is a shorter driven gear pin 32 which is also recessed into block 11. Drive gear 33 rotates on main pin 31, tight against the face 10 while driven gear 34 which meshes with drive gear 33 is rotably supported by pin 32 and is tight against face 10. A plurality of drive pins 35 which fit both into the holder 28 and into the gear 33, being concentric about pin 31 comprises one preferred mean of driving gear 33 from holder 28. Thus as the motor 21 turns the magnet 26, magnet 27 is turned and gears 33 and 34 are driven thereby.

Inlet and outlet ducts 36, 37 extend inward from face 10 into the pump block 11 on opposite sides of the mesh point of the gears 33 and 34. The pump block 11 is formed at suitable locations with inlet and outlet ports 38, 39 which communicate with the ducts 36, 37, respectively. One of the features of the invention is the fact that the block 11 is of simple construction and the ports 38, 39 may be located in a variety of positions, as has heretofore been explained. Further, the block 11 may be rotated by interchanging the screws 19.

Figure 2:
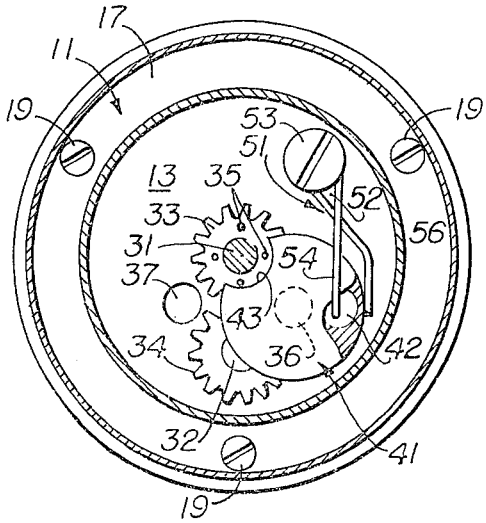
FIG. 2 is a sectional view taken substantially along the line 2—2 of FIG. 1.
Figure 7:
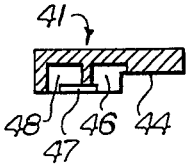
FIG. 7 is a sectional view taken substantailly along the line 7—7 of FIG. 5.
Figure 5:
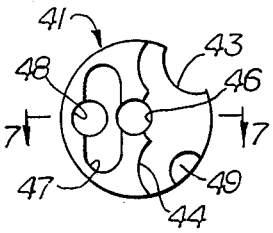
FIG. 5 is a view of the shoe substantially along the line 5—5 of FIG. 1.
Figure 6:
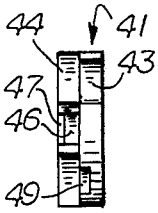
FIG. 6 is a side elevational view of the structure of FIG. 5.

An important feature of the invention is the use of a shoe 41 which is located within the cavity 13 and covers both the opening of the duct 36 and also the mesh point of the gears 33, 34 and about two teeth to either side of the mesh point. The shoe 41 is supported by a third pin 42 which is recessed into the block 11 parallel to the pins 31, 32. As best shown in FIG. 2, an arc 43 is cut into the edge of shoe 41 for clearance of the pins 35. Directing attention now to FIGS. 5–7, a recess 44 is formed in the underside of the shoe 41 for clearance of the gears 33, 34 which fit into said recess. A deeper recess 46 is formed directly opposite inlet duct 36 and hence fluid entering through duct 36 enters the recess 46 and then passes into the recess 44 at the mesh point of the gears. The bore 48 receives the pin 42 which supports shoe 41. An elongated very shallow recess 47 is located between the recesses 46 and 48. Recess 49 provides clearance for the end of pin 32.

When the pump is running, the pressure within the cavity 13 is the discharge pressure while the pressure in duct 36 is the inlet pressure. This pressure differential forces the shoe 41 against face 10 and against the flanks of the gears 33, 34. Recess 47, which is connected with recess 46, insures that suction pressure exists over that face of side 41 which is in contact with face 10. However, when the pump is started, spring 51 is used to hold the shoe 41 in place until the pressure differential takes over. Spring 51 is formed with an eye 52 at its mid point and a screw 53 through eye 52 and threaded into the pump block 11 holds the spring 51 in place. One leg 54 of the spring 51 overlies the outer face of shoe 41 and the other leg 56 which is bent in a dog-leg biases the edge of the shoe 41 toward the mesh point of the gears.

The pump heretofore described is subject to considerable variation, depending upon the use to which it is to be put. Thus the block 11 may be readily modified to locate the ports 38, 39 to fit the customer's installation in which the pump will be a part. The block 11 is a simple member formed with ducts 36, 37 and holes for the pins 31, 32, 42. The gears 33, 34 may be constructed of materials to accommodate the fluids being handled and the temperature, pressure and viscosity involved.

Fluid at inlet pressure enters the cavity 13 through duct 36 and is confined by the shoe 41 to flow to the mesh point of the gears 33, 34. The gear 33 is turned by the motor 21 as heretofore explained, and fluid is pumped by the gears into the cavity 13 at high pressure which causes the shoe 41 to be forced against the gears and face 10 and the fluid is pumped from cavity 13 out through the duct 37.

Figure 8:
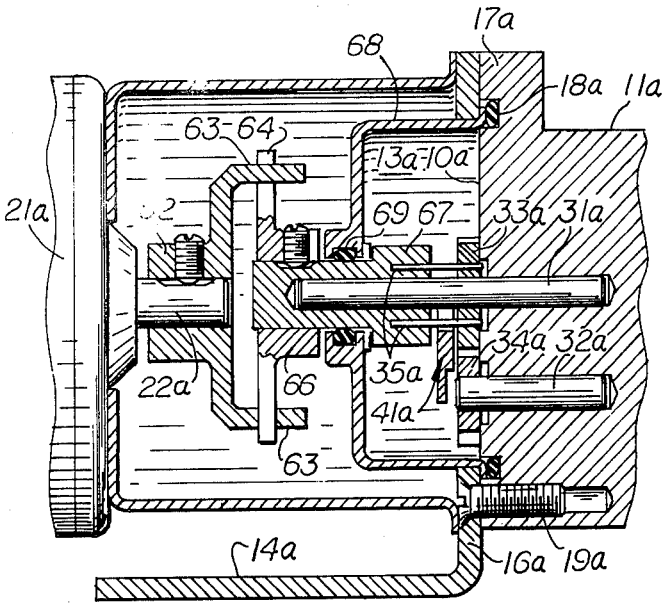
FIG. 8 is a view similar to FIG. 1 showing a modified drive for the pump.
Figure 3:
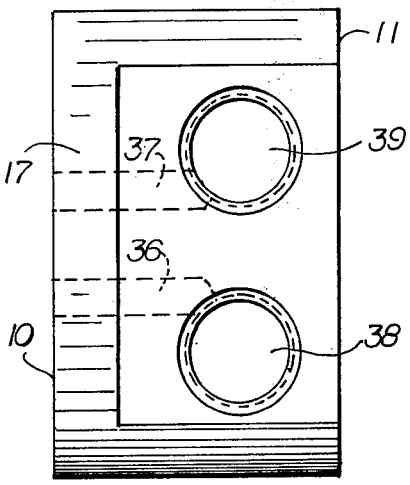
FIG. 3 is a top plan of the pump body in one of its various forms.
Figure 4:
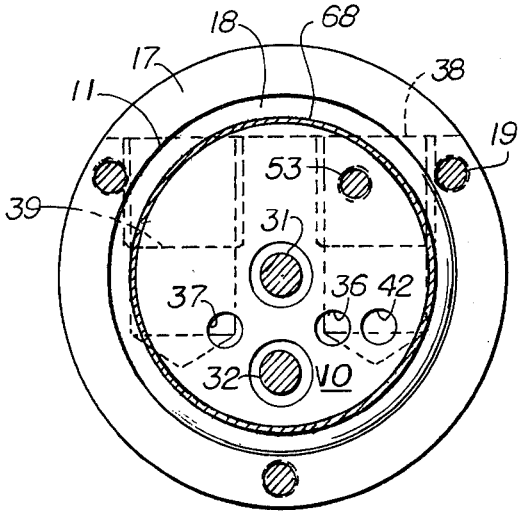
FIG. 4 is a view taken substantially along the line 4—4 of FIG. 1.

Turning now to the modification of FIG. 8, instead of a magnetic drive between the motor **21*a* and the drive gear 23*a*, a direct drive is employed. Thus fixed to turn with the motor shaft 22*a* is the hub 62 which has bifurcated ends 63. Fitting against and turned by the ends 63 are arms 64 which extend outward from hub 63 fixed for rotation with fitting 67 which is in longitudinal alignment with the main pin 31*a* and is formed with a bore to receive said pin. The fitting 67 extends inside a cup-shaped member 68 which is sealed by seal 18*a* to the face 10*a* of block 11*a* and defines the pump cavity 13*a*. A packing gland 69 seals the cup member 68 against leakage as the fitting 67 turns. The fitting 67 is connected to the drive gear 33*a* by a plurality of drive pins 35*a*. In other respects the modification of FIG. 8 resembles that of FIGS. 1–7 and corresponding parts are marked with the same reference numerals followed by the subscript a. In its operation, the pump of FIG. 8 is similar to that of FIG. 1. It will further be understood that the drive between the motor 21*a* and the gear 33*a*** is only one of many which may be used.

What is claimed is:

1. A pump comprising, means defining a pump cavity, said cavity having a wall having a planar first surface a drive gear and a driven gear in said cavity each having planar second and third surfaces, said second surfaces bearing and sealing against said first surface, said gears meshing together at a mesh point, means for driving said drive gear an inlet duct in said wall adjacent said mesh point, a concave shoe in said cavity overlying said inlet duct and a portion only of each of said gears including said mesh point, means mounting said shoe on said wall, said shoe having:

a planar fourth surface sealing against said first surface, a planar fifth surface sealing against portions of said third surfaces of said gears on either side of said mesh point and an arcuate sixth sealing surface sealing against some of the tips of both said gears adjacent said mesh point, said fourth, fifth and sixth surfaces being located on one side only of said shoe, and an outlet duct in said cavity remote from said shoe, whereby said shoe, said gears and said first surface define a closed chamber around said inlet duct within said cavity.

2. A pump according to claim 1 in which said shoe comprises a disk formed with a first recess providing space for rotation of said gears and a second recess communicating with said first recess and with said inlet duct.

3. A pump according to claim 1 which further comprises a spring in said cavity biasing said shoe into close contact with said third surfaces of said gears.

4. A pump according to claim 1 in which said means for driving said drive gear comprises a pair of magnets, one said magnet being connected to be turned by a motor, the other said magnet being connected to turn one of said gears, said magnets being on opposite sides of said means defining a pump cavity.

5. A pump according to claim 1 which further comprises a motor and means interconnecting said motor and drive gear for rotation together.

6. A pump according to claim 1 in which said wall comprises a face of a pump block, said ducts being formed in said block, three parallel pins recessed into said wall and extending into said cavity, said pins mounting said drive gear, driven gear and shoe, respectively.

7. A pump according to claim 6 in which said pump block is formed with an inlet port and an outlet port communicating with said inlet and outlet ducts, respectively.

8. A pump according to claim 6 which further comprises a cup, seal means sealing the rim of said cup to said wall, said cup and said wall defining said pump cavity.

9. A pump according to claim 8 which further comprises a driven magnet within said pump cavity, means mounting said driven magnet on the first of said pins, said last-named means and said drive gear being fixed for rotation together, a drive magnet outside said pump cavity concentric with said driven magnet and a motor to turn said drive magnet.

* * * * *